United States Patent [19]

George et al.

[11] 4,010,879

[45] Mar. 8, 1977

[54] GARMENT HANGER

[76] Inventors: Paul J. George, P.O. Box 86, Brecksville, Ohio 44141; M. Ted Raptes, 2111 Jefferson Davis Highway, Arlington, Va. 22202

[22] Filed: Dec. 1, 1975

[21] Appl. No.: 636,610

Related U.S. Application Data

[63] Continuation-in-part of Ser. No. 401,292, Sept. 27, 1973, Pat. No. 3,923,213.

[52] U.S. Cl. ..... 223/96; 24/255 A; 24/84 H; 24/255 G

[51] Int. Cl.[2] ..... A47J 51/94

[58] Field of Search ..... 223/85, 91, 96; 24/255 SL, 255 GC, 255 GP, 137 R, 84 A, 84 H, 252 DP, 84 R, 255 A, DIG. 18

[56] References Cited

UNITED STATES PATENTS

| | | | |
|---|---|---|---|
| 1,474,102 | 11/1923 | Ashmore | 223/96 X |
| 2,885,758 | 5/1959 | Russo et al. | 24/255 GP |
| 2,977,001 | 3/1961 | Vitale | 223/85 X |
| 3,063,749 | 11/1962 | Struble et al. | 24/DIG. 18 |
| 3,405,429 | 10/1968 | Vazquez | 223/96 X |
| 3,515,319 | 6/1970 | Furtak et al. | 223/85 |
| 3,527,357 | 9/1970 | Johnson | 223/96 X |
| 3,616,497 | 11/1971 | Esposito | 24/255 A |
| 3,744,686 | 7/1973 | Levitin | 223/96 |
| 3,865,287 | 2/1975 | Peterson | 223/96 |

FOREIGN PATENTS OR APPLICATIONS

| | | | |
|---|---|---|---|
| 1,058,094 | 2/1967 | United Kingdom | 24/255 A |

*Primary Examiner*—George H. Krizmanich

[57] ABSTRACT

A garment or pants hanger, particularly constructed of a plastic material, comprises an arcuate yoke means having a spring action, grippers adapted to grip the garment, means for opening the grippers, and means for hanging the hanger. The yoke means are spring-biased to maintain the grippers in a closed position to retain a garment therebetween. The grippers are opened by squeezing angled arm means.

9 Claims, 8 Drawing Figures

GARMENT HANGER

This application is a continuation-in-part of copending application Ser. No. 401,292 filed Sept. 27, 1973 now U.S. Pat. No. 3,923,213.

BACKGROUND OF THE INVENTION

This invention relates to a novel improved, simplified garment hanger, and more particularly to a device for gripping and hanging clothing articles such as trousers, skirts and the like.

Conventional prior art garment hangers, readily available, are usually made from wire or wood and combinations thereof. Most of the well known types of hangers grip the trousers near the cuffs and permit the trouser to hand free therefrom. This type of hanger is shown in U.S. Pat. Nos. 3,070,270; 3,262,167 and 3,362,594. Other types of hangers are adapted to fit into the cuffs of trousers, or the hanger is adapted to grip, by an external squeezing action a top part of the garment of the cuffs of trousers. These devices, although accomplishing the desired results, are somewhat complicated and crumbersome to use and relatively expensive to manufacture, requiring several components to be assembled together.

BRIEF SUMMARY OF THE INVENTION

An object of this invention is to provide a simlified garmet or parts hanger adapted to simply grip a top portion of the garmet permitting it to hang freely.

Another object of this invention is to provide a simplified garment or pants hanger made completely of a plastic material.

A further object of this invention is to provide a simplified garment or pants hanger having a spring action for gripping a portion of the garment, which is present in the plastic structure of the hanger.

Another object of this invention is to provide a garment or pants hanger wherein the operation of the hanger is simple and direct, and permits the garment to be gripped in one simple action.

The above objects along with others will be readily apparent by referring to the following description and claims of preferred embodiments thereof, taken in conjunction with the accompanying drawings.

DETAILED DESCRIPTION OF THE INVENTION AND THE PREFERRED EMBODIMENTS

Figure 1:
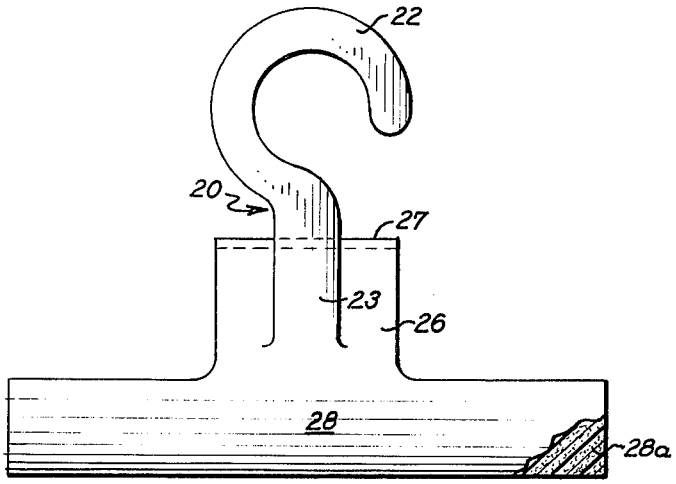
FIG. 1 is a side elevational view of an embodiment of a garment hanger of the invention.

Referring now to the drawings, FIGS. 1–4 depict an embodiment of a garment hanger of the invention. The numeral 20 generally denotes a unitary hanger device manufactured completely from a plastic material by molding or extrusion as will be explained more fully hereinafter. The device generally comprises a pair of upwardly extending hooks 22 and 24 having a conventional configuration, a yoke 26, and a pair of grippers 28 and 30.

Figure 3:
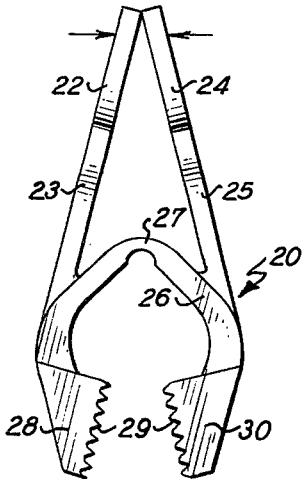
FIG. 3 is an end elevational view of the hanger shown in FIG. 1 in the open position.

The hooks are vertical and parallel to each other and are adapted to provide two functions. One function is for hanging the hanger and garment on a horizontal pole, and the second function is to be squeezed together, as shown in FIG. 3, to separate the grippers 28 and 30 from each other. The hooks 22 and 24 are joined to the sides of the yoke 26 by vertical members 23 and 25, respectively, which are unitary extensions of the hooks.

Figure 2:
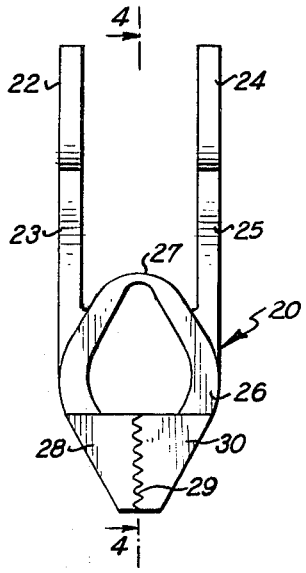
FIG. 2 is an end elevational view of the hanger shown in FIG. 1 in the closed position.

The yoke 26 has a generally arcuate or curved, cross-sectional configuation between the vertical members 23 and 25. At its midpoint 27, the thickness is less than the rest of the yoke. The yoke has a spring action function, due to the nature of plastic material, biased to keep the grippers 28 and 30 in a closed position as shown in FIG. 2. On squeezing the hooks 22 and 24 towards each other, the spring action of the yoke permits the grippers 28 and 30 to be separated as shown in FIG. 3. The spring action of the yoke is designed to flex particularly at the midpoint 27 because of the thinner portion. However, although the thinner portion 27 functions to advantage, it is within concept of this invention to use a yoke having the same thickness throughout, which will also function with a spring action.

The grippers 28 and 30 are adapted to grip between them a pair of trouser cuffs, the top hem of a skirt, and the like. Each gripper comprises an inner gripping surface 29, adapted to frictionally hold a garment by the squeezing spring action of the yoke 26 when the grippers are in the closed position. The surface 29 shown in FIGS. 2,3 and 4 is a series of parallel longitudinal ridges on each gripper, preferably angled slightly upwardly.

When using hanger 20, the two cuffs of trousers, or the hems of a skirt, are put together, the hooks 22 and 24 are squeezed together to separate the grippers 28 and 30, and while separated, the cuffs are merely placed between the grippers, the hooks are then released permitting the grippers to grip or clamp the cuffs between them, whereby the remainder of the trousers are allowed to hand free. The hanger and trousers can then be hung on a horizontal clothes pole, or the like, by means of the hooks 22 and 24. It is to be noted that the hooks 22 and 24 provide a certain amount of horizontal separation between adjacent hangers on a clothes pole, whereby adjacent trousers are kept somewhat separated, thereby permitting the trousers to hang freely without interference from adjacent trousers or garments. In addition, when it is desired to remove a pair of trousers from the hanger, it is not necessary to remove the hanger from the clothes pole, it being merely necessary to squeeze the hooks to remove the trousers and the hanger remains on the clothes pole.

Figure 4:
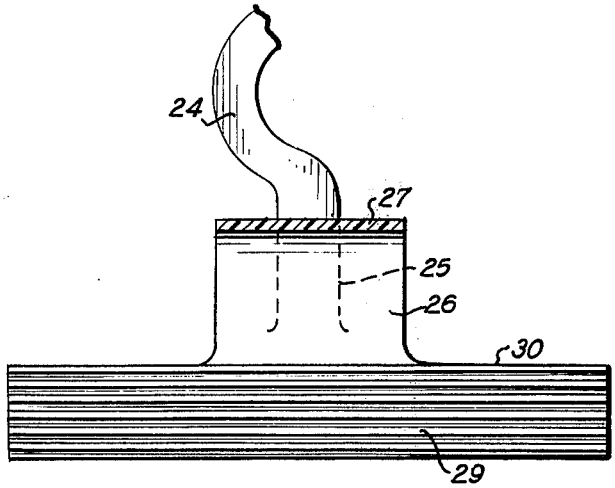
FIG. 4 is a sectional view taken along line 4—4 of FIG. 2 showing one type of gripping surface used in the garment hanger of the invention.
Figure 7:
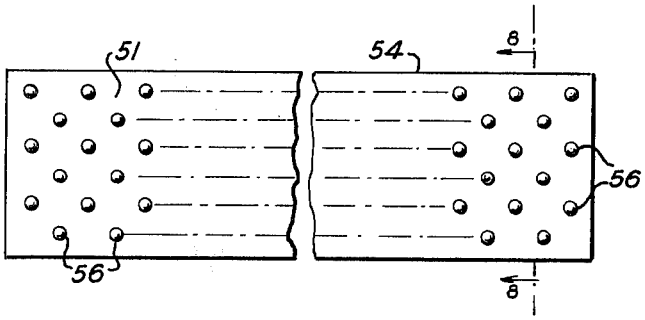
FIG. 7 is a side view of another type of gripping surface used in the garment hangers of this invention.
Figure 8:
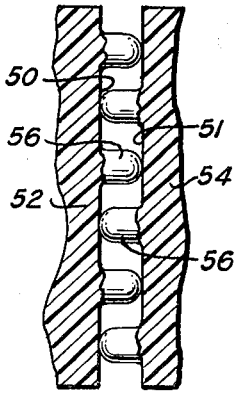
FIG. 8 is a sectional view taken along line 8—8 of FIG. 7.

In FIGS. 7 and 8, there is depicted another type of gripping surface than the one shown in FIGS. 2,3 and 4. The gripping surfaces 50 and 51 of grippers 52 and 53, respectively, comprise a plurality of round, small, proturberances 56 on each gripper surface, spaced in a grid pattern relationship to each other on each surface, whereby the protuberances engage the opposite surfaces and not each other when the grippers 52 and 54 are in engagement. The arrangement of protuberances 56 provides a positive gripping action or garments.

Figure 5:
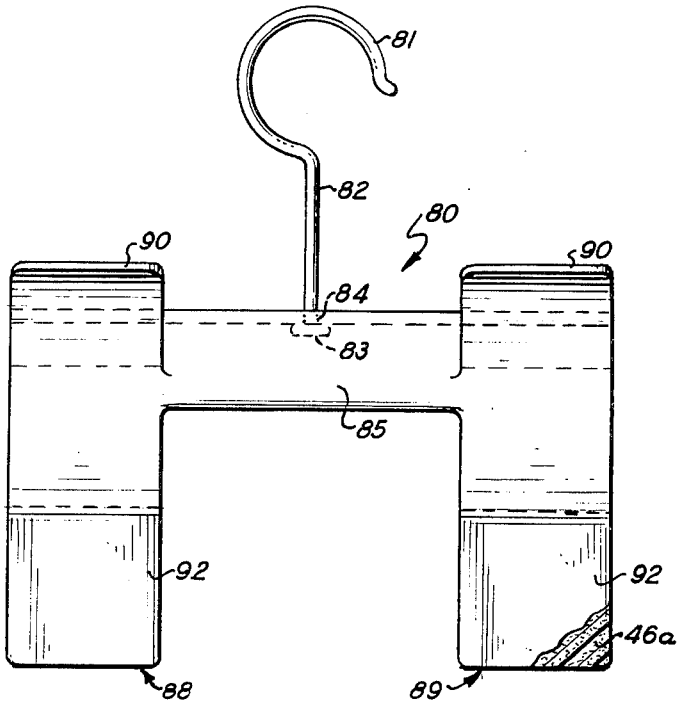
FIG. 5 is a side elevational view of another embodiment of a garment hanger of this invention.
Figure 6:
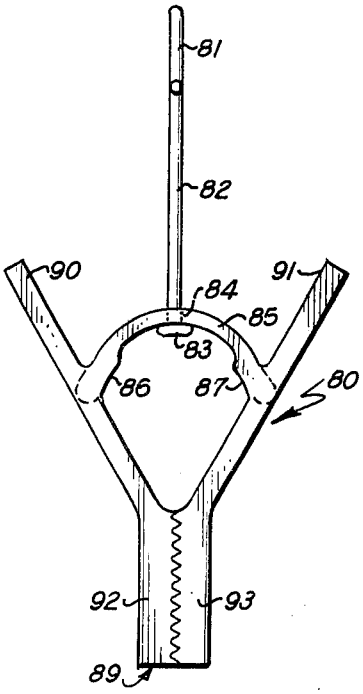
FIG. 6 is an end elevational view of the hanger shown in FIG. 5.

In FIGS. 5 and 6, another embodiment 80 of a hanger of this invention is depicted. Hanger 80 comprises a single unitary hook 81 and vertical member 82 having a knob end 83 connected by suitable means such as through a hole 84 to a yoke 85. Yoke 85 is a generally arcuate or curved cross-sectional configuration having the heretofore described spring action and somewhat thickened portions 86 and 87 where the yoke is connected to gripper devices generally shown by the numerals 88 and 89 at each end. Each gripper device 88 and 89 comprises a pair of upwardly and outwardly angled squeeze arms 90 and 91, joined to yoke 85, and a pair of grippers 92 and 93 of the types described heretofore. Hanger 80 is used by inserting the ends of trouser cuffs, or a skirt, at each end of the hanger, by first inserting one end of the cuff between the grippers 92 and 93 of gripper device 89 by squeezing the upper parts of arms 90 and 91 to open the grippers, and thereafter similarly between the grippers of gripping device 88. The separate gripping action of gripping devices 88 and 89 permit smoothing and pulling taut of the cuffs or skirt between the gripping device.

The above described hanger embodiments can be easily manufactured or fabricated from plastic materials by any of the usual methods which are suitable or applicable, such as, injection molding, extrusion, or calendering; but the design itself would in many cases dictate the final choice. Thus, a given part may be hot-stamped out of a calendered sheet, then post-formed into the final shape. Or, a continuous extrusion may be cut into individual hanger components for final assembly. Certain parts, such as the hook, may be most easily formed by injection molding. The spring action of the yoke, and its requirement that sufficient gripping action be supplied to the grippers, requires plastic materials having specific properties which are available on the market. Particularly suitable because of their low cost are PVC (polyvinylchloride), ABS (acrylonitrile-butadiene-styrene), PS (polystyrene), PE (polyethylene), and PP (polypropylene). All of these offer a wide range of properties and processing characteristics making them desirable for fabrication into the articles of this invention. Besides the advantage of being low-cost resins, each of these is capable of modification by the incorporation of suitable additives, fillers, or reinforcing agents well known in the trade to enable one to achieve any combination of properties desired in the final plastic part. For example, the stiffness of PP can be greatly increased by the incorporation of suitable fillers (shown at 28*a* in FIG. 1) such as glass fibers, talc, or asbestos. The tensile strength and the rigidity of PE, especially the high density PE's, can be readily increased by the addition of reinforcing fillers such as clay or glass fibers. Although PVC possesses one of the best combinations of stiffness and impact strength among the plastics, it properties can be further modified by incorporating glass or thermoplastic fibers, or asbestos fibers (shown at 46*a* in FIG. 5) to increase dimensional stability. Following is a listing of the filler types which can be used with the plastics in this invention:

| TYPE | EXAMPLES |
|---|---|
| Silica products | Sand, diatomaceous earth, fumed colloidal silica, etc. |
| Silicates | Talc, asbestos, mica, etc. |
| Glass | Glass flakes, spheres, etc. |
| Calcium carbonate | Chalk, precipitated calcium carbonate |
| Metallic oxides | Alumina, titania, zinc oxide, etc. |
| Inorganic compounds | Barium sulfate, molybdenum disulfide |
| Metal powders | Aluminum, bronze, zinc, etc. |
| Carbon | Carbon black, ground petroleum coke |
| Cellulosic fillers | Wood flour, shell flour |
| Comminuted polymers | Phenolic resins, polystyrene, etc. |

The following is a listing of fibrous reinforcement for plastics useful in this invention:

| TYPE | EXAMPLES |
|---|---|
| Cellulose | Rayon, jute, cotton flock-cellulose |
| Asbestos | |
| Carbon | |
| Fibrous glass | Filaments, glass fabric, yarn strand |
| Synthetic fibers | Polyamide (Nylon), polyester (Dacron), polyacrylonitrile (Orlon), polyvinyl alcohol |
| Metallic fibers, whiskers | |

Although plastic materials are preferred and are excellently suitable in the manufacture of the hangers of this invention, it is also contemplated that other materials can be used. Thus, metal which possess a spring action can be used for the yoke devices and the grippers and hooks can be assembled thereto. Suitable metals include steel, aluminum, and the like.

The gripper surfaces described with the embodiments are all suitable for use with each hanger embodiment. In addition, to the frictional gripping means shown in FIGS. 4 and 7, other frictional gripping means (not shown) can be used on the gripping surfaces. Thus, for example, gripping surfaces on grippers 92 and 93 can have a gripping material such as felt of "Velcro" material disposed by suitable means thereon. With the use of felt of Velcro material, the grippers 92 and 93 can be molded with flat gripping surfaces on which the felt and Velcro can be secured (Velcro is registered trademark of the Velcro Corporation). In addition, it is also contemplated that certain combinations can be used with two grippers. Thus, the surfaces shown in FIGS. 4 or 7 could either be used in combination with an opposing surface of Velcro material, belt, and the like.

Although, the hook 81 is shown as being removable, it is within the scope of the invention to permanently secure the end of the hook in hole 84 by suitable means. Alternatively, the hanger can be provided with other types of suspending means than the hook 81 to suspend the garment hanger from horizontal pole means and the like. Thus, for example, a ring (not shown) can be permanently secured to the yoke of the hanger, and the ring can be fitted over a horizontal pole, whereby the hanger is movable across the pole but not removable therefrom. In addition, a rod can be permanently secured at one end to the yoke means with the other end having a knob, or similar means, which can ride in track means disposed on a horizontal bar.

Having now described the invention in specific detail and exemplified the manner in which it may be carried into practice, it will be readily apparent to those skilled in the art that innumerable variations, applications, modifications and extensions of the basic principle involved may be made without departing from its spirit or scope.

What is claimed is:

1. A one-piece hanger fabricated from a plastic material for gripping and hanging a garment permitting it to hang freely comprising gripper means, spring-biased yoke means, gripper separating means, and hanger suspending means:

a. said spring-biasing yoke means having a spring action property and a generally arcuate form extending horizontally;

b. gripper means and gripper separating means disposed at opposite ends of said yoke means;

c. each of said gripper separating means comprising a pair of arm members angled downwardly towards each other, each arm member connected at an intermediate portion thereof to the side of said yoke means;

d. said gripper means comprising horizontally-extending gripper members connected to and coextensive with the lower end of each of said arm members; each of said gripper members having an inwardly disposed vertical gripping surface comprising a planar dimensional area having frictional gripping means; both of said gripping surfaces being normally spring-biased by said yoke means in a parallel, closed, contacting position;

e. said suspending means extending upwardly and connected to an upper medial portion of said yoke means for suspending said hanger;

whereby said gripper means at each end can be easily separated by squeezing respective arm members towards each other to thereby enable a garment to be inserted and frictionally held between said gripper members at each end of said hanger upon release of said arm members.

2. The hanger of claim 1 wherein said gripping surfaces comprise parallel horizontal ridges.

3. The hanger of claim 1 wherein said gripping surfaces comprise a grid pattern of a plurality of small protuberances.

4. The hanger of claim 1 wherein said gripping surfaces comprise velcro material.

5. The hanger of claim 1 wherein said arcuate yoke means comprises a longitudinal thin medial portion.

6. The hanger of claim 1 wherein said components thereof are fabricated from a plastic material selected from the group consisting of polyvinylchloride, polystyrene, polyethylene, polypropylene, acrylonitrial-butadiene-styrene, filler reinforced plastics, and fibrous reinforced plastics.

7. The hanger of claim 1 wherein said hanger suspending means comprises hook means.

8. The hanger of claim 7 wherein said suspending means comprises ring means.

9. The hange of claim 7 wherein said suspending means comprises knob means adapted to be engaged in track means.

* * * * *